US006883536B2

(12) United States Patent
Hervio et al.

(10) Patent No.: US 6,883,536 B2
(45) Date of Patent: Apr. 26, 2005

(54) PRESSURIZED FLUID TANK, IN PARTICULAR COMPRESSED GAS TANK FOR A MOTOR VEHICLE

(75) Inventors: Antoine Hervio, Saint Aubin de Medoc (FR); Philippe Malarge, Le Haillan (FR); Jacques Pescheux, Saint Aubin de Medoc (FR)

(73) Assignee: SNECMA Propulsion Solide, Le Haillan (FR)

( * ) Notice: Subject to any disclaimer, the term of this patent is extended or adjusted under 35 U.S.C. 154(b) by 0 days.

(21) Appl. No.: 10/479,791

(22) PCT Filed: Apr. 7, 2003

(86) PCT No.: PCT/FR03/01085

§ 371 (c)(1),
(2), (4) Date: Dec. 5, 2003

(87) PCT Pub. No.: WO03/085314

PCT Pub. Date: Oct. 16, 2003

(65) Prior Publication Data

US 2004/0226607 A1 Nov. 18, 2004

(30) Foreign Application Priority Data

Apr. 8, 2002 (FR) ..... 02 04346

(51) Int. Cl.[7] ..... F17D 1/00
(52) U.S. Cl. ..... 137/259; 137/265
(58) Field of Search ..... 137/259, 265, 137/255, 256; 206/503, 504; 222/143

(56) References Cited

U.S. PATENT DOCUMENTS 2,676,743 A * 4/1954 Babson et al. ..... 137/265
3,662,780 A 5/1972 Marsh
5,908,134 A 6/1999 Hale et al.
6,227,230 B1 * 5/2001 Huh ..... 137/265

FOREIGN PATENT DOCUMENTS

| | | |
|---|---|---|
| DE | 30 26 116 A | 2/1982 |
| GB | 488 534 A | 7/1938 |
| WO | WO 97 28401 A | 8/1997 |
| WO | WO 98/26209 | 6/1998 |

OTHER PUBLICATIONS

* Patent Abstracts of Japan, vol. 1999, No. 01, Jan. 29, 1999, –& JP 10 274391 A (Kobe Steel Ltd.), Oct. 13, 1998, Abstract.

–& Database WPI Week 199851, Derwent Publications Ltd., London, GB; AN 1998–604047, XP002231277 –& JP 10 274391 A (Kobe Steel Ltd.), Oct. 13, 1998, Abstract.

* cited by examiner

*Primary Examiner*—Kevin Lee
(74) *Attorney, Agent, or Firm*—Weingarten, Schurgin, Gagnebin & Lebovici LLP

(57) ABSTRACT

The tank for fluid under pressure comprises one or an assembled-together plurality of individual containers or modules made at least in part out of composite material. The or each individual container (20) comprises a cylindrical body (22) of composite material, two end plates (30) closing the axial ends of the cylindrical body, and at least one belt passing around the container substantially in a longitudinal direction and bearing against portions of the outside faces of the end plates.

17 Claims, 6 Drawing Sheets

PRESSURIZED FLUID TANK, IN PARTICULAR COMPRESSED GAS TANK FOR A MOTOR VEHICLE

This application is a 371 national phase of PCT/FR03/01085 filed Apr. 7, 2003, and claims priority to a French application No. 02 04346 filed Apr. 8, 2002.

FIELD OF THE INVENTION

The invention relates to a tank for fluid under high pressure, i.e. pressure greater than 1 megapascal (MPa).

A particular, but non-exclusive, field of application for the invention is that of vehicle natural gas (VNG) tanks for containing gas compressed to about 20 MPa for motor vehicles.

BACKGROUND OF THE INVENTION

The development of vehicle propulsion using gaseous or liquefied fuels under pressure has led to a search for fuel storage techniques that make the following possible under the best possible safety conditions:

- obtaining as high as possible an index of volume performance or filling coefficient (ratio of on-board volume to authorized size);
- obtaining as high as possible a construction index (ratio of on-board volume to tank mass); and
- using low cost technologies.

With a liquefied petroleum gas (LPG) engine, service pressures are relatively low (about 1 MPa), so the construction index is less discriminating than the other factors.

In contrast, with a VNG engine, pressure is much higher, about 20 MPa. In this field, existing tanks are made up of one or more individual containers or modules of generally cylindrical shape made either of metal or of composite material.

A tank enabling fluid to be stored under high pressure while maintaining a good filling coefficient is proposed in patent application WO 98/26209. That prior art tank is made up of a plurality of individual tubular containers and presents polymorphic architecture with the following particular advantages:

- it is very easy to adapt to the available space;
- it is modular;
- its storage volume is subdivided and it is possible, where necessary, to isolate individual containers in order to satisfy safety objectives; and
- its mass is relatively low since the wall thickness requirement for each individual container is much less than that which would apply to a single-bodied tank with the same total working volume.

When the modules are made of metal, they present a construction index that is relatively low. For modules made of composite material, the construction index is considerably higher, however the constraints concerning ability to withstand pressure lead to greater wall thickness, thereby affecting the filling coefficient. In addition, making monolithic tanks of the bottom+ferrule type out of composite material leads to significant manufacturing constraints, in particular for implementing the winding and/or draping of the fiber reinforcement of the composite material, and also for the necessary tooling, in particular mandrels or formers which must enable the wound or draped structure to be removed.

Patent application DE 3 026 116 proposes making a pressurized fluid tank comprising a plurality of tank portions in mutual contact via plane walls. The tank portions are held together by peripheral straps. Covers close the tank portions at their longitudinal ends. Longitudinal straps bear on the adjacent edges of the covers and contribute to holding them in place.

The fact that each cover is held by a single longitudinal strap which bears on a portion of the edge of the cover does not guarantee an ability to withstand high pressures.

In addition, the fact that each longitudinal strap is shared between two tank portions limits flexibility in tank construction, and in particular it does not enable tank portions of different lengths to be assembled together.

An improvement in the ability of tanks to withstand pressure by using straps is also described in document JP 10-274391 which shows the use of peripheral straps in the form of fiber-reinforced tapes.

OBJECT AND SUMMARY OF THE INVENTION

An object of the invention is to propose pressurized fluid tanks made up of one or a plurality of individual containers, but with simplified construction of the individual containers and thus significant reduction in manufacturing costs, while enabling containers to be obtained that are compact and that provide high performance.

Another object of the invention is to propose tanks presenting excellent ability to withstand high pressures, typically pressures of the order of those encountered in VNG tanks, i.e. about 20 MPa.

Another object of the invention is to make highly flexible modular structure possible, and in particular a structure of tanks of various shapes adaptable to the space available for receiving the tanks.

These objects are achieved by the fact that the or each container comprises a cylindrical body of composite material, two end plates closing the axial ends of the cylindrical body, and at least two straps passing around the container substantially in its longitudinal direction and bearing against portions of the outside faces of the end plates, which straps are disposed on either side of a mid-longitudinal plane of the cylindrical body.

Making each container as a cylindrical body associated with two end plates held in place by two longitudinal straps provides a certain number of advantages:

- the cylindrical body can be dimensioned to withstand solely the radial forces generated by the internal pressure, thus allowing wall thickness to be small;
- separating the functions of taking up radial forces and of taking up longitudinal forces enlarges the range of materials that can be used for the cylindrical body, the strap(s), and the end plates, and enlarges the range of dimensions that can be used for these parts;
- since the cylindrical body is of constant section, various continuous or semi-continuous methods of manufacture can be used, i.e. not only techniques of winding or draping, but other processes for obtaining tubular structures of composite material, such as the "pultrusion" processes;
- the use of two longitudinal straps enables the end plates to be held securely on the cylindrical body, including under high pressures; and
- the space between the straps, at at least one of the end plates, can be used for forming a recess enabling measuring, safety, or connection equipment to be housed without penalizing overall size.

The straps may be made of metal or of composite material. If they are made of composite material, they include fiber reinforcement made using continuous fibers.

The end plates may be made of metal or of structural composite material.

Advantageously, each strap passes along a groove formed in the outside face of each end plate.

Also advantageously, each end plate is in the form of a plug with a portion that is engaged in leaktight manner in one end of the cylindrical body. An element for preventing rotation may also be provided between the cylindrical body and at least one of the end plates in order to prevent the end plate from turning relative to the cylindrical body about its axis.

The cylindrical body and the end plates of each container may be provided with an internal coating of fluid-tight material, depending on the natures of the materials constituting the container and the nature of the fluid contained.

When there are a plurality of containers, they advantageously occupy volumes in the form of prisms or rectangular parallelepipeds defined by the end plates, thus enabling the containers to be assembled together in modular manner by placing them side by side.

Mechanical connection between two adjacent containers can then be obtained by a mechanical link member e.g. connecting them together via the adjacent end plates of these two containers.

In a variant, the containers may be assembled as a bundle, being held together at least in part by a device placed around the bundle. The containers may be of different lengths.

The inside volumes of two adjacent containers may be put into communication with each other via at least one fluid connection interconnecting adjacent end plates of the two containers.

In a variant, or in addition, at least some of the containers may be connected to a fluid manifold via at least one outlet formed through an end plate.

BRIEF DESCRIPTION OF THE DRAWINGS

Other features and advantages of the tank of the invention appear on reading the following description given by way of non-limiting indication and with reference to the accompanying drawings, in which.

DETAILED DESCRIPTION OF EMBODIMENTS OF THE INVENTION

Figure 1:
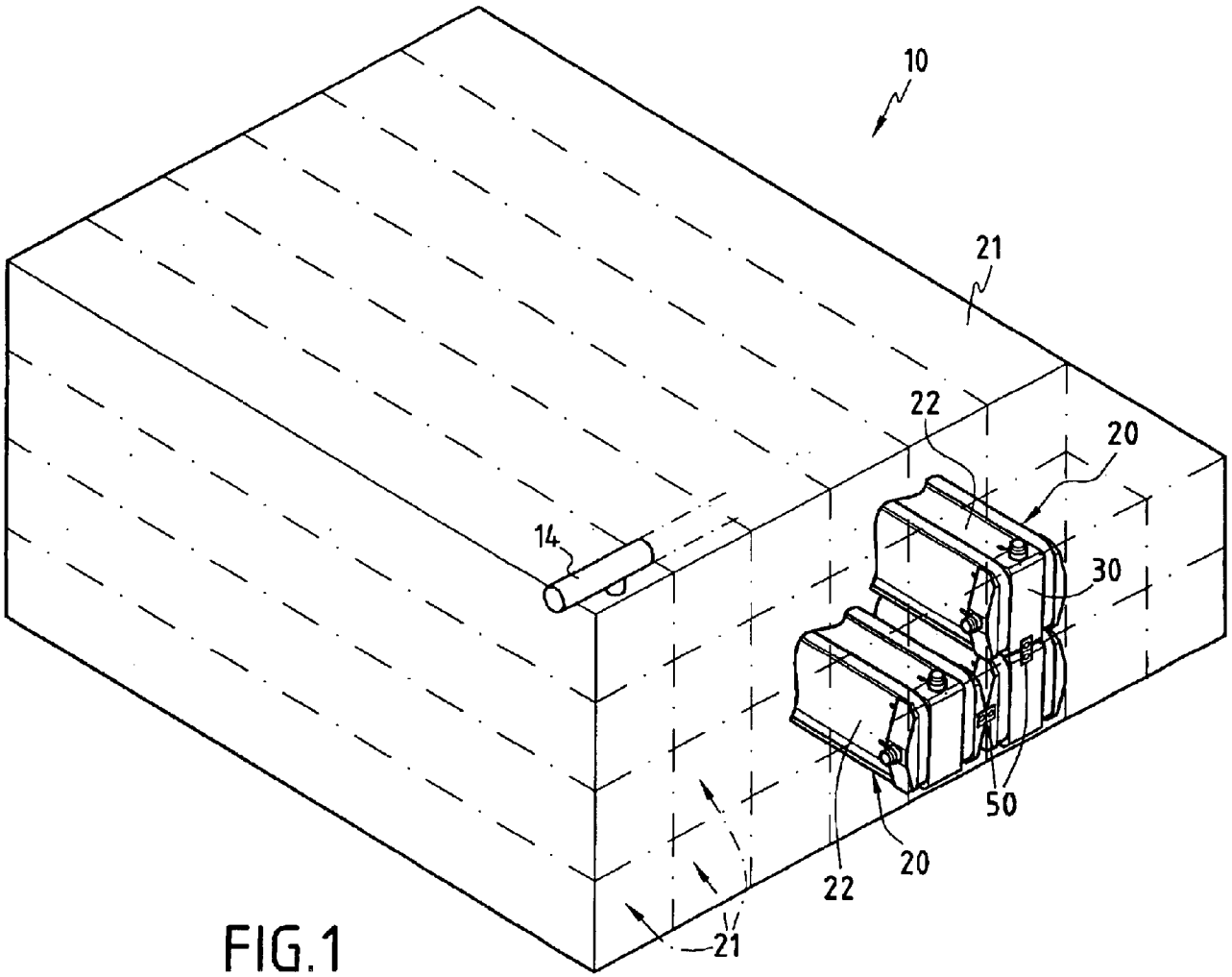
FIG. 1 is a highly diagrammatic fragmentary perspective view of an embodiment of a tank in accordance with the invention.

FIG. 1 shows a tank 10 made up as an assembly of individual modules or containers 20 placed side by side (not all of them are shown). Each container 20 comprises a generally cylindrical body 22 closed at its axial ends by respective end plates 30. The containers 20 are disposed parallel to one another, each being contained within the volume of a rectangular parallelepiped 21 defined by the shape of the end plates 30. The set of containers is contained within a volume defined by the space allowed for receiving it. In cross-section, this set occupies an optionally regular polygon, and some of the containers may be of lengths that differ from the lengths of other containers so that the tank can present portions that are set back or that project (not shown in FIG. 1).

Figure 2:
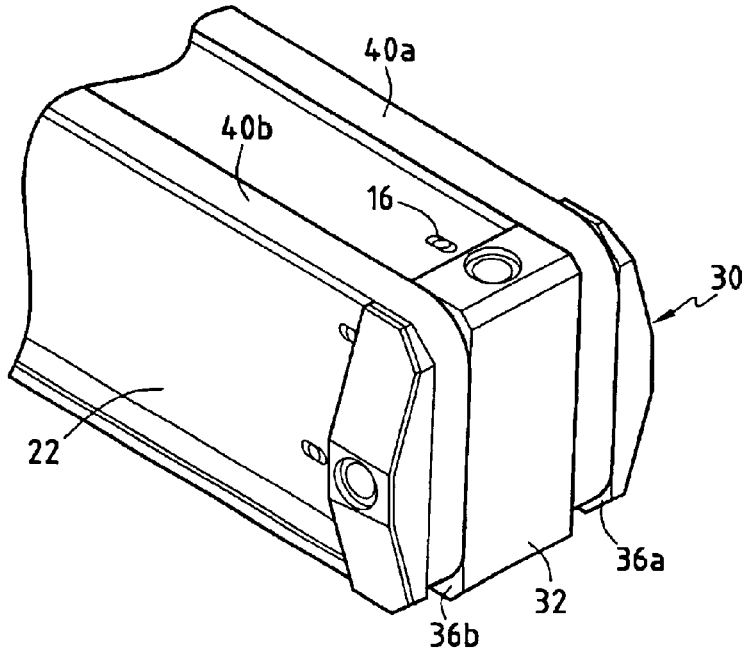
FIG. 2 is a fragmentary perspective view on a larger scale of an individual container of the FIG. 1 tank.
Figure 3:
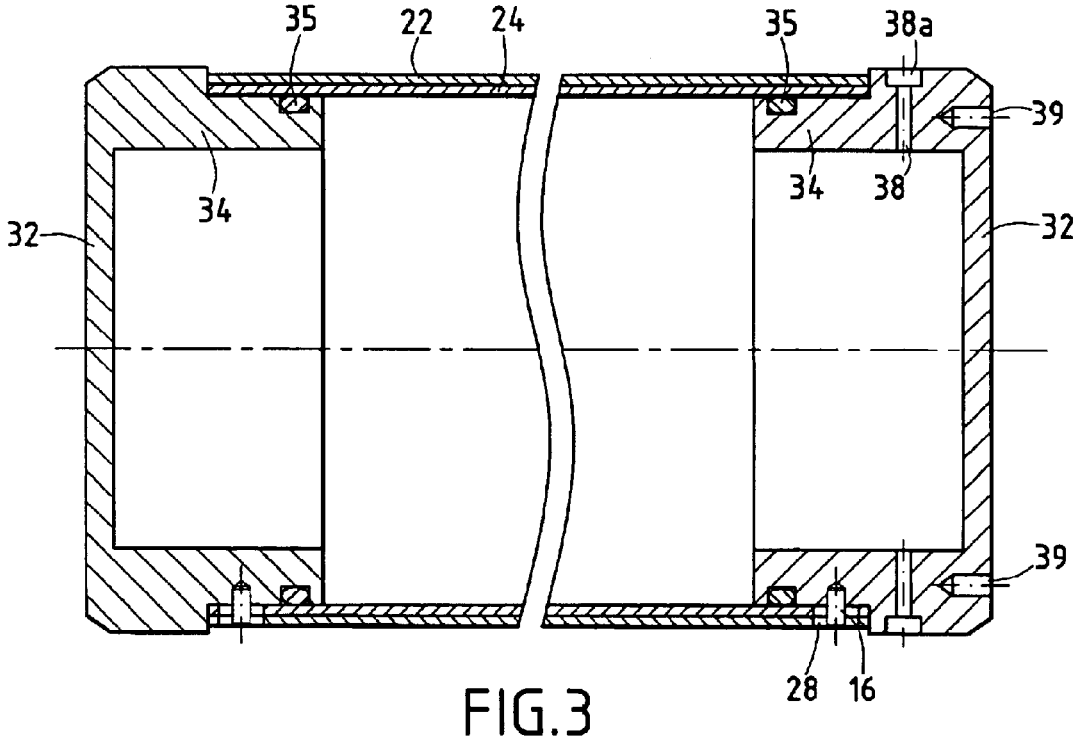
FIG. 3 is a fragmentary longitudinal section view of the FIG. 2 container.

FIGS. 2 and 3 show an individual container 20 in greater detail. The cylindrical body 22, e.g. of circular section, is made of a structural composite material comprising fiber reinforcement densified by a matrix. By way of example, the reinforcing fibers may be fibers of carbon, glass, aramid, polyethylene, etc. By way of example the matrix may be a thermoplastic or a thermosetting resin. The cylindrical body 22 may also be made of a thermostructural composite material with reinforcing fibers and a matrix of carbon or ceramic.

The cylindrical body 22 gives the container 20 the ability to withstand the radial component of the pressure of the fluid it contains.

Various known methods can be used for making the cylindrical body 22, such as winding pre-impregnated threads on a mandrel, winding pre-impregnated fiber plies or strips on a mandrel, or indeed molding plies with resin transfer (resin transfer molding or "RTM"). The cylindrical shape also allows a "pultrusion" method to be used enabling tubes of great length to be made continuously with the cylindrical body 22 being cut therefrom to desired lengths.

The cylindrical body 22 is provided, where necessary, on its inside face with a coating 24 (or "liner") that is fluid-tight and of substantially constant thickness. The coating 24 may be in the form of a metal foil, e.g. of aluminum alloy, or it may be a plastics material, e.g. polyethylene or polytetrafluoroethylene (PTFE), or it may be an elastomer. The coating 24 is present over at least the entire surface that comes into contact with the fluid.

The coating 24 may be stuck to the inside face of the cylindrical body 22 after it has been made. In a variant, the coating 24 may be integrated therein while the cylindrical body 22 is being manufactured, for example by winding or draping directly onto the coating foil or by performing pultrusion while simultaneously feeding in the coating material.

The end plates 30 closing the ends of the cylindrical body 22 are in the form of plugs, each comprising a head 32 which bears against the end of the cylindrical body, and a skirt 24 which penetrates inside it.

The end plates may be made as a single piece of structural composite material. Like the cylindrical body 22, the end plates may be provided, where necessary, with a fluid-tight coating on their inside surfaces, which coating is made continuously with the coating 24 of the cylindrical body 22.

The end plates 30 are preferably made as a single piece of metal material, e.g. of aluminum alloy.

The head 32 is of polygonal cross-section suitable for being inscribed in the section of the rectangular parallelelpiped volume 21 defining the space available for the container 20.

The skirt 34 presents at least one groove which receives a sealing ring 35 which bears against the inside face of the coating 24.

In order to prevent each end plate 30 from turning relative to the cylindrical body 22 about its axis, rotation is stopped by means of one or more pins 16, for example, each received through a slot 28 formed in the wall of the cylindrical body 22 and in a blind hole formed in the skirt 34 on the outside of the sealing ring 35 relative to the internal volume of the container. The slot 28 extends in the longitudinal direction so as to allow relative axial displacement between the cylindrical body and the end plate when the container is under pressure.

The ability of the end plates 30 to withstand the axial pressure exerted by the fluid contained in the individual tank 20 is provided by at least two straps 40*a* and 40*b*. These straps extend around the container 20 in the longitudinal direction bearing against the outside faces of the end plates 30. Advantageously, the straps 40*a* and 40*b* are received in grooves 36*a* and 36*b* formed in the end faces of the heads 32 of the end plates so that the straps are effectively held in position.

The depth of the grooves 36*a* and 36*b* is selected so that the entire thickness of the straps 40*a* and 40*b* is received therein without any projections on the outside faces of the heads 32. The grooves 36*a* and 36*b* thus perform a function of protecting the straps at the end of the container in addition to the guidance function that they perform. An intermediate layer, e.g. of elastomer, may be placed between the bottoms of the grooves 36*a* and 36*b* and the straps that bear on the intermediate layer.

The straps 40*a* and 40*b* may be constituted by metal strips fixed around the container. The straps are preferably made of a structural composite material having fiber reinforcements and a matrix, e.g. a resin matrix. The reinforcing fibers are continuous fibers providing the ability to withstand longitudinal forces. The fibers may be made of carbon, glass, aramid, polyethylene, etc., and the matrix may be a phenolic resin or an epoxy resin, for example. The straps 40*a* and 40*b* can then be put into place by winding filaments or fiber fabric in strip form that is pre-impregnated with the resin of the matrix.

The two straps 40*a* and 40*b* extend along mutually parallel planes situated on either side of a midplane of the container. As a result, the straps 40*a* and 40*b* and the portions in relief of the grooves 36*a* and 36*b* are inscribed in the rectangular parallelepiped volume 21 and do not increase overall size.

Although the use of two straps is preferred, it is also possible to provide for more than two straps, for example with one or more additional straps disposed in planes that are not parallel to the planes of the straps 40*a* and 40*b*, and crossing over the straps where they pass over the heads 32 of the end plates.

In the embodiment of FIGS. 1 to 3, each individual container is in internal communication with each or at least one of its neighbors at one end.

Figure 4:
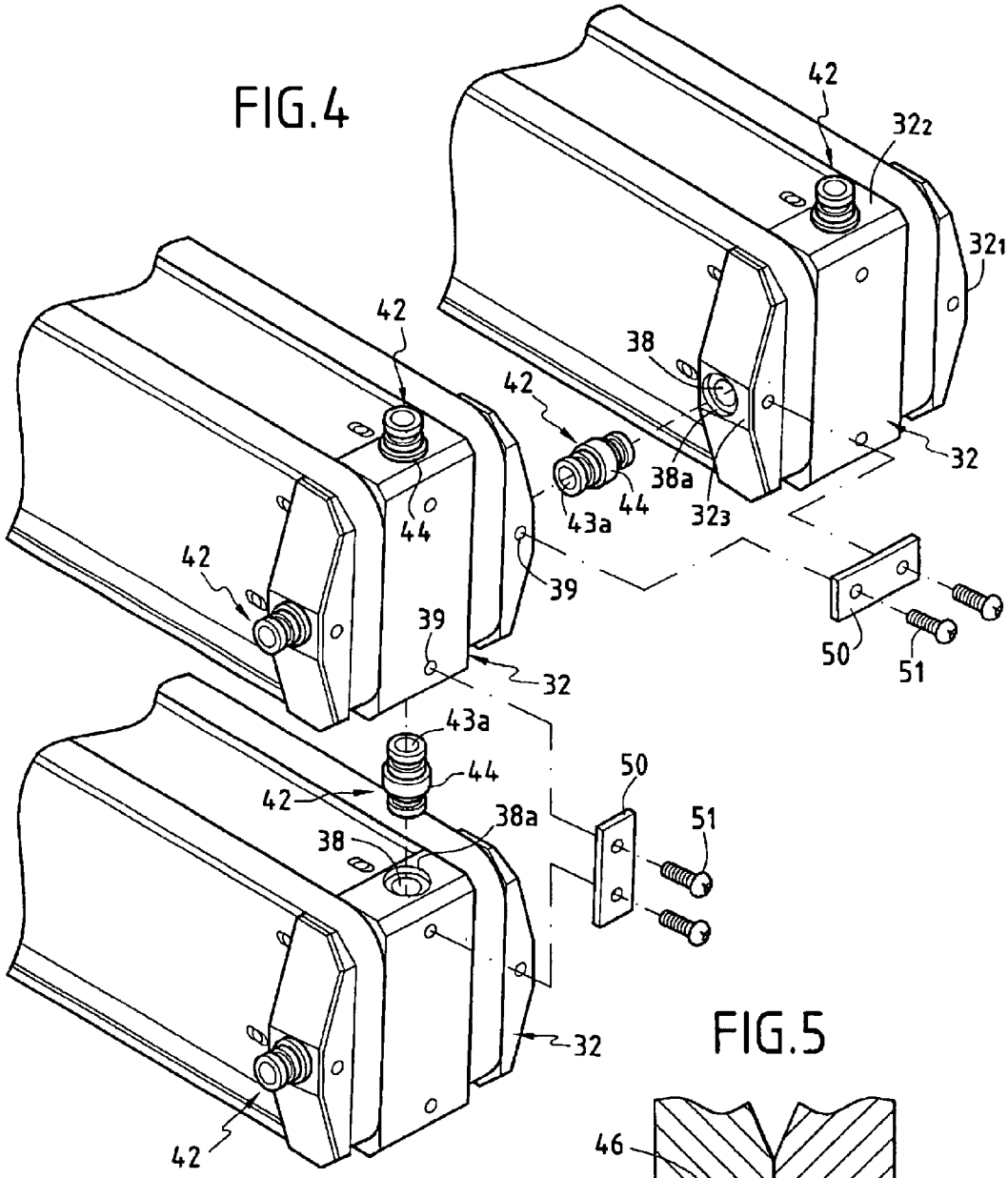
FIG. 4 is a fragmentary exploded view in perspective at the larger scale showing an embodiment of a coupling between adjacent containers in the FIG. 1 tank.
Figure 5:
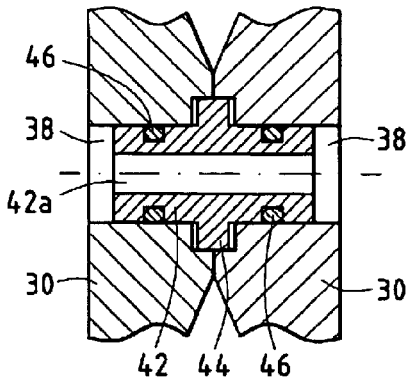
FIG. 5 is a fragmentary section view of the coupling between two adjacent containers in the FIG. 4 embodiment.

For this purpose, and as shown in FIGS. 4 and 5, tubular couplings 42 provided with respective internal passages 42*a* are designed to be inserted in holes 38 formed in at least one of the side faces $\mathbf{32}_1$, $\mathbf{32}_2$, $\mathbf{32}_3$, $\mathbf{32}_4$ of the heads 32 of the end plates 30. Sealing rings 46 are also mounted on the couplings 42 so as to be interposed between the portions of the couplings that penetrate into the holes 38 and the inside walls of the holes. Each tubular coupling 42 is held in position between two adjacent end plates by the presence of a collar 44 received in setbacks 38*a* formed in the adjacent side faces of the flasks 30, for example.

Communication between the internal volumes of two adjacent containers is thus provided by the tubular couplings 42 and the holes 38 which open out into the internal volume of a cylindrical body through the skirts 34 of the end plates (see FIG. 3).

Each container is in natural direct physical contact with one or more adjacent containers via the side faces $\mathbf{32}_1$, $\mathbf{32}_2$, $\mathbf{32}_3$, $\mathbf{32}_4$ of the end plates 30. The containers can be assembled together by means of local fasteners such as fishplates 50 fixed by means of screws 51 engaged in holes 39 in the heads 32 of the end plates 30 (see FIGS. 1 and 4).

Connections by means of fishplates are made at both ends of the containers.

Figure 6:
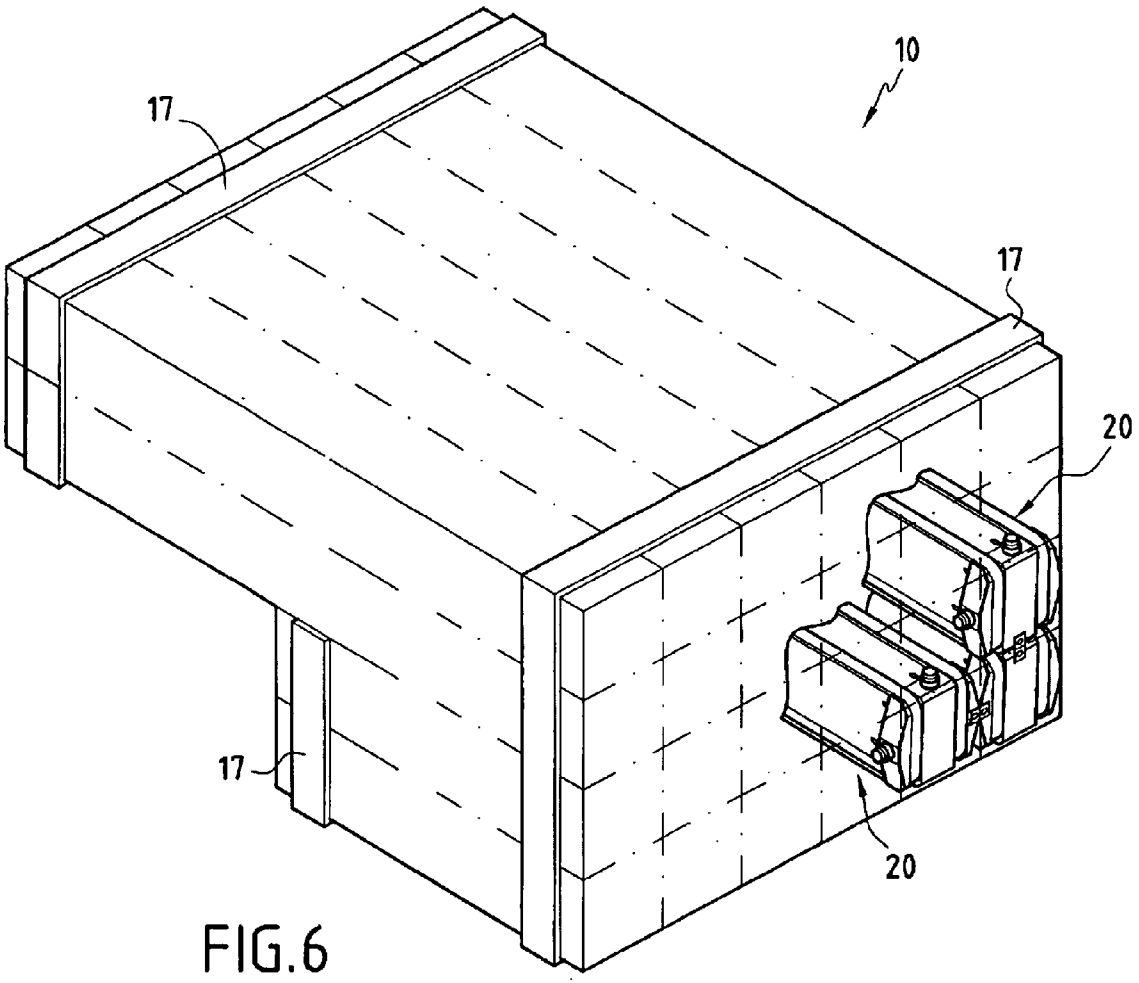
FIG. 6 is a highly diagrammatic view showing a variant assembly configuration of tank-forming containers.

In a variant, or in addition, the tank assembly may be held together by at least one belt 17 passing around the tank 10 level with the end plates, perpendicularly to the axes of the individual containers, as shown in FIG. 6. The tank may be made up of containers of different lengths.

When the containers 20 are interconnected directly, fluid connection between the tank and a fluid take-off tube 14 (FIG. 1) can be provided via a single container 20 at the point on the tank which is most suitable given its configuration in use.

Figure 7:
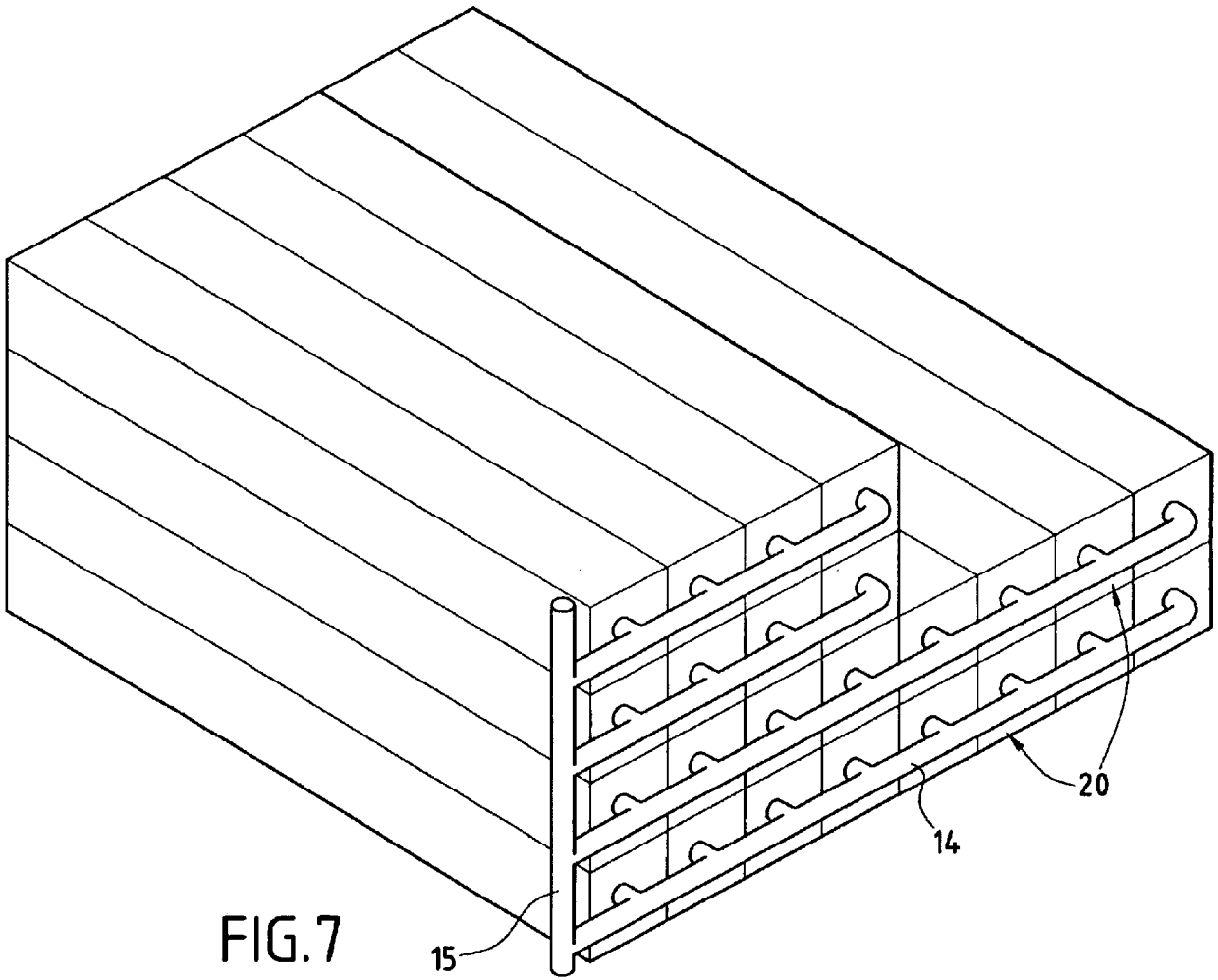
FIG. 7 is a highly diagrammatic view of a variant connection configuration between the internal volumes of the containers forming a tank.

In a variant, and if necessary, in particular when the containers are not interconnected or are not all interconnected, multiple fluid connections between one or more take-off tubes and the individual containers can be implemented. FIG. 7 is a highly diagrammatic view of containers each connected at one end to a manifold-forming tube 14. The manifold tubes 14 are connected together via a fluid take-off pipe 15 which may then also serve mechanically to hold the containers 20 together.

The lengths and/or dispositions of the containers may be selected so as to confer the desired general shape to the tank (see FIGS. 6 and 7) corresponding to the space available for housing the tank.

A tank 10 as described above is particularly suitable for storing gas under pressure in a motor vehicle running on VNG. It is then advantageously provided with a protective shield made of metal or of composite material (not shown), as is known per se (reference can be made to above-cited document WO 98/26209), at least for protecting the visible portions made of composite material from external aggression.

Figure 8:
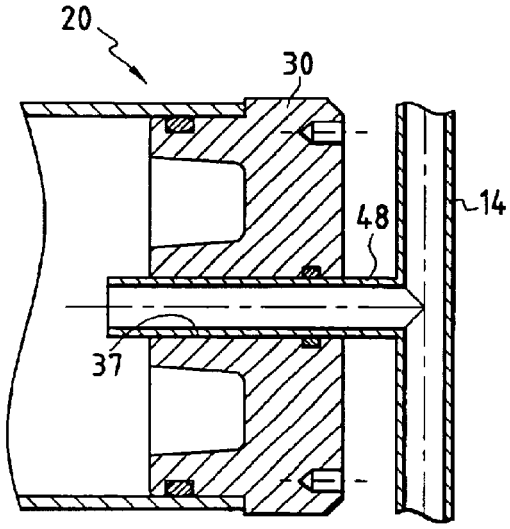
FIG. 8 is a diagrammatic section view showing a coupling between a container of a tank and a manifold tube.

FIG. 8 shows how the connection of the internal volume of a container 20 is made with a manifold tube 14. A duct 48 is connected to a hole 37 formed in the head 32 of the end plate 30 at one end of the individual tank. The duct 48 is connected to a manifold tube 14.

A similar disposition can be provided at the other end of the individual tank, in which case it is not connected to a single manifold tube, but to two manifold tubes.

Advantageously, the space between the straps at the end plates is used for receiving at least one piece of measuring, safety, or coupling equipment such as a pressure gauge, an isolating system, a thermal fuse, a flow rate limiter, or a coupling with a manifold tube. This disposition enables the equipment to be integrated inside the volume of the tank, and also contributes to protecting it.

Figure 9:
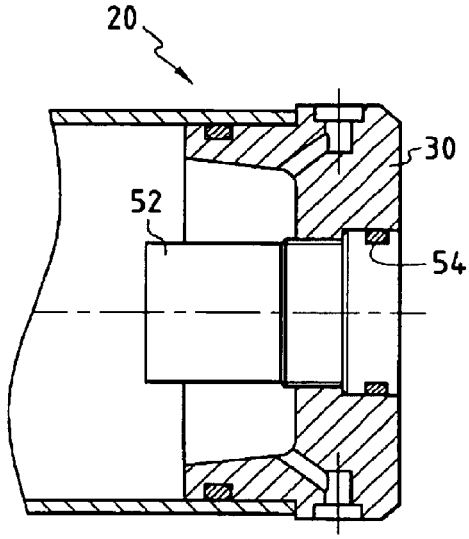
FIGS. 9 to 11 are section views showing variant embodiments of a container end plate suitable for housing equipment.

In the example shown in FIG. 9, the equipment 52, e.g. a pressure gauge, is screwed into a central opening formed in the end plate 30, with a sealing ring 54 being interposed.

Figure 10:
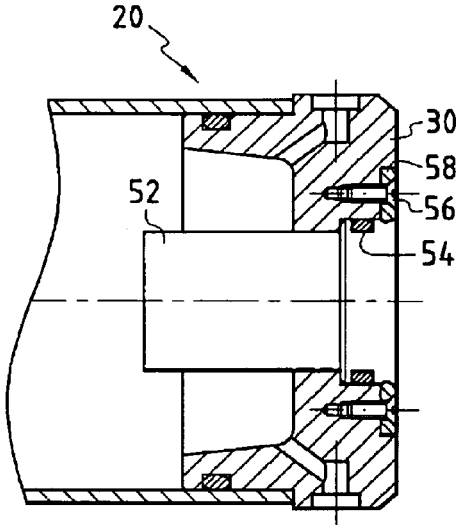

In the embodiment of FIG. 10, the equipment 52 is likewise inserted in a central opening of the end plate 30 together with a sealing ring 54, but mechanical connection is provided by a screw 56 passing through a flange 58 on the equipment 52.

Figure 11:
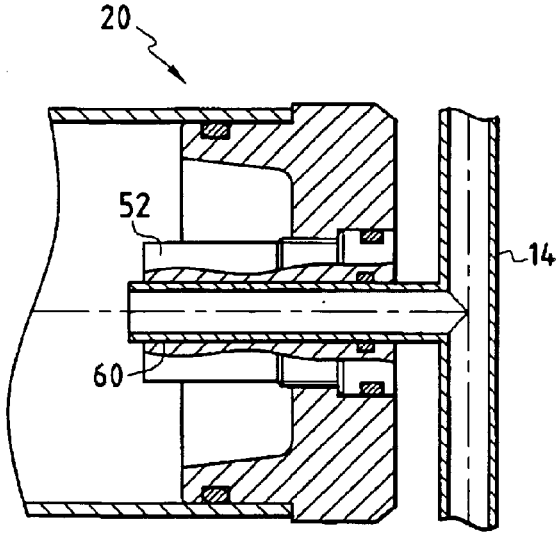

The embodiment of FIG. 11 differs from that of FIG. 9 in that the equipment 52 has a duct 60 passing therethrough enabling the internal volume of the container to be connected to a manifold tube 14. In the embodiment of FIG. 11, the equipment 52 could alternatively be connected to the end plate by means of screws, as shown in FIG. 10.

Naturally, other variants could be envisaged without going beyond the ambit of the invention.

Thus, the volume in which each individual container can be inscribed could be of a prismatic shape other than a rectangular parallelepiped, depending on the shape of the end plate heads. For example, the heads of the end plates could have a cross-section that is hexagonal.

In addition, a tank may be made up of a plurality of subassemblies each comprising an assembly of individual containers interconnected by pipes. An embodiment of a tank configuration made up of such subassemblies serves to take maximum advantage of the various spaces available in a vehicle.

In addition, the tank could comprise a single container made in a manner similar to that described above for the individual containers.

Finally, although the intended application is for a gas tank for a motor vehicle running on VNG, the invention is applicable to any tank for fluid under high pressure.

What is claimed is:

1. A tank for fluid under pressure, the tank comprising one or more individual containers or modules assembled together and made at least in part out of composite material, the tank being characterized in that the or each individual container comprises a cylindrical body of composite material, two end plates closing the axial ends of the cylindrical body, and at least two straps passing around the container substantially in its longitudinal direction and bearing against portions of the outside faces of the end plates, which straps are disposed on either side of a mid-longitudinal plane of the cylindrical body.

2. A tank according to claim 1, characterized in that at least one of the end plates of a container carries measuring, safety, or connection equipment housed in a space situated between the straps.

3. A tank according to claim 1, characterized in that the straps are made of composite material with continuous fiber reinforcement.

4. A tank according to claim 1, characterized in that the end plates are made of composite material and are provided with a fluid-proof coating on their inside surfaces.

5. A tank according to claim 1, characterized in that the end plates are made of metal.

6. A tank according to claim 1, characterized in that each strap passes in a groove formed in the outside face of each end plate.

7. A tank according to claim 1, characterized in that each end plate is in the form of a plug with a portion engaged in leaktight manner in one end of the cylindrical body.

8. A tank according to claim 1, characterized in that the cylindrical body of each container is provided with an internal coating of fluid-proof material.

9. A tank according to claim 1, characterized in that at least one element is provided to prevent rotation between the cylindrical body and at least one end plate so as to prevent the end plate turning relative to the cylindrical body about its axis.

10. A tank according to claim 1, comprising a plurality of individual containers the tank being characterized in that two containers situated side by side are in mutual direct physical contact via adjacent end plates.

11. A tank according to claim 1, comprising a plurality of individual containers, the tank being characterized in that two adjacent containers are mechanically connected together by at least one mechanical link member interconnecting the end plates situated side by side of the two containers.

12. A tank according to claim 1, comprising a plurality of individual containers, the tank being characterized in that the internal volumes of two adjacent containers are in communication with each other via at least one connection pipe interconnecting end plates situated side by side of the two containers.

13. A tank according to claim 1, characterized in that at least some of the individual containers are connected to a fluid take-off via at least one outlet formed through an end plate.

14. A tank according to claim 1, characterized in that a plurality of individual containers form a bundle of containers held together at least in part by a device passing around the bundle.

15. A tank according to claim 1, characterized in that it comprises a plurality of individual containers having different lengths.

16. A tank according to claim 1, characterized in that it is provided with a protective shield.

17. A tank according to claim 3, characterized in that:

the end plates are made of one of composite material and are provided with a fluid-proof coating on their inside surfaces or metal;

each strap passes in a groove formed in the outside face of each end plate;

each end plate is in the form of a plug with a portion engaged in leaktight manner in one end of the cylindrical body;

the cylindrical body of each container is provided with an internal coating of fluid-proof material;

at least one element is provided to prevent rotation between the cylindrical body and at least one end plate so as to prevent the end plate turning relative to the cylindrical body about its axis;

it further comprises:

a plurality of individual containers, the tank being characterized in that two containers situated side by side are in mutual direct physical contact via adjacent end plates;

a plurality of individual containers, the tank being characterized in that two adjacent containers are mechanically connected together by at least one mechanical link member interconnecting the end plates situated side by side of the two containers;

a plurality of individual containers, the tank being characterized in that the internal volumes of two adjacent containers are in communication with each other via at least one connection pipe interconnecting end plates situated side by side of the two containers;

at least some of the individual containers are connected to a fluid take-off via at least one outlet formed through an end plate;

a plurality of individual containers form a bundle of containers held together at least in part by a device passing around the bundle;

it comprises a plurality of individual containers having different lengths;

it is provided with a protective shield.

* * * * *